US009905939B2

(12) United States Patent
Yamagajo et al.

(10) Patent No.: US 9,905,939 B2
(45) Date of Patent: Feb. 27, 2018

(54) ANTENNA DEVICE

(71) Applicant: FUJITSU LIMITED, Kawasaki-shi, Kanagawa (JP)

(72) Inventors: Takashi Yamagajo, Yokosuka (JP); Masahiko Shimizu, Kawasaki (JP); Makoto Yoshida, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 154 days.

(21) Appl. No.: 14/953,710

(22) Filed: Nov. 30, 2015

(65) Prior Publication Data

US 2016/0204518 A1 Jul. 14, 2016

(30) Foreign Application Priority Data

Jan. 9, 2015 (JP) ..... 2015-003692

(51) Int. Cl.
*H01Q 21/24* (2006.01)

(52) U.S. Cl.
CPC ..... *H01Q 21/24* (2013.01)

(58) Field of Classification Search
CPC ..... H01Q 21/24
USPC ..... 343/809
See application file for complete search history.

(56) References Cited

U.S. PATENT DOCUMENTS

2011/0309984 A1* 12/2011 Chiu ..... H01Q 5/371 343/700 MS
2014/0240181 A1 8/2014 Mamuro et al.

FOREIGN PATENT DOCUMENTS

| | | |
|---|---|---|
| JP | 11-205028 | 7/1999 |
| JP | 2008-017384 | 1/2008 |
| JP | 2013-183437 | 9/2013 |

* cited by examiner

*Primary Examiner* — Andrea Lindgren Baltzell
(74) *Attorney, Agent, or Firm* — Fujitsu Patent Center

(57) ABSTRACT

An antenna device includes: a first antenna element configured to radiate first radio waves having a first plane of polarization; and a second antenna element configured to radiate second radio waves having a second plane of polarization orthogonal to the first plane of polarization, wherein ends of the first antenna element and the second antenna element located at mutually approaching sides are disposed in a positional relationship, and a phase deviation caused by an electromagnetic coupling based on the positional relationship is compensated and an electrical power is fed to the first antenna element and the second antenna element with a phase difference that causes a composite wave of the first radio waves and the second radio waves to form a circularly polarized wave.

14 Claims, 9 Drawing Sheets

Theta/Degree vs.dB

Main lobe magnitude = 5.52dB
Main lobe direction = 5.0deg.
Angular width(3dB) = 108.8deg.

ANTENNA DEVICE

CROSS-REFERENCE TO RELATED APPLICATION

This application is based upon and claims the benefit of priority from the prior Japanese Patent Application No. 2015-003692, filed on Jan. 9, 2015, the entire contents of which are incorporated herein by reference.

FIELD

The embodiments discussed herein are related to, for example, an antenna device.

BACKGROUND

In a Radio Frequency IDentification (RFID) system which is an automatic recognition system, individual information of a person or an object stored in a medium called an RFID tag is read or written by a wireless communication with a wireless communication device called a reader/writer.

A related technique is disclosed in, for example, Japanese Laid-open Patent Publication No. 2008-017384.

SUMMARY

According to one aspect of the embodiments, an antenna device includes: a first antenna element configured to radiate first radio waves having a first plane of polarization; and a second antenna element configured to radiate second radio waves having a second plane of polarization orthogonal to the first plane of polarization, wherein ends of the first antenna element and the second antenna element located at mutually approaching sides are disposed in a positional relationship, and a phase deviation caused by an electromagnetic coupling based on the positional relationship is compensated and an electrical power is fed to the first antenna element and the second antenna element with a phase difference that causes a composite wave of the first radio waves and the second radio waves to form a circularly polarized wave.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

Figure 1:
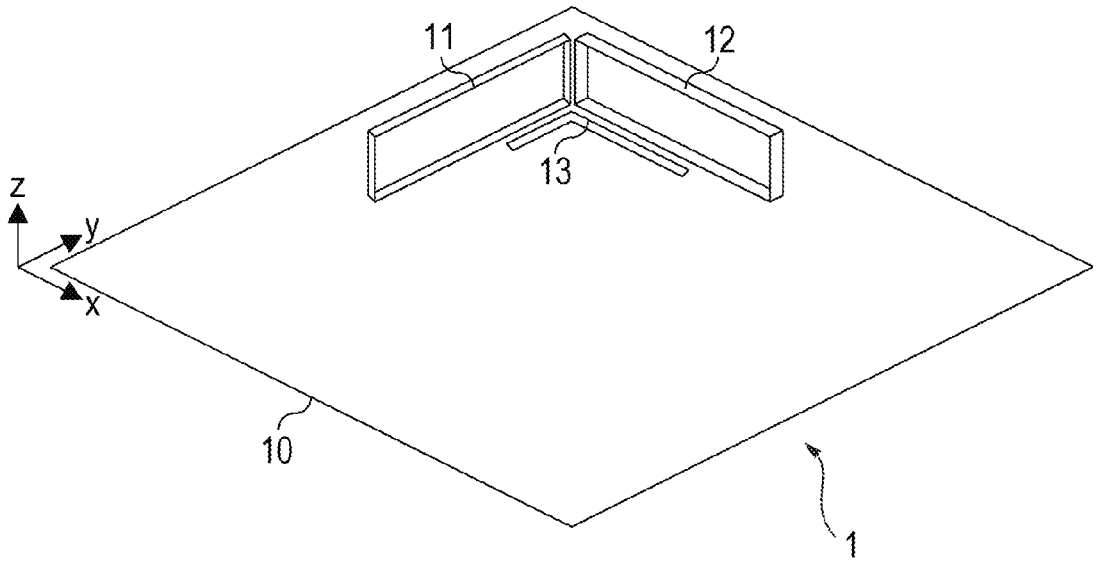
FIG. 1 illustrates an example of a perspective view of an antenna device.

A linearly polarized wave antenna is frequently used as an RFID tag side antenna. Therefore, in order to allow a radio signal to be transmitted and received even when the RFID tag is directed in any direction, a circularly polarized wave antenna radiating a circularly polarized wave is used as a reader/writer side antenna.

A wristwatch having a function of specifying a location thereof using a Global Positioning System (GPS) is equipped with a circularly polarized wave antenna as an antenna for GPS used in the high frequency band in order to receive radio waves from, for example, a GPS satellite.

In the circularly polarized wave antenna like this, when a conductor such as a metal is placed in the vicinity of the circularly polarized wave antenna, antenna characteristics such as a gain may be significantly deteriorated. For example, in a case where a patch antenna for GPS is provided within the wristwatch, the patch antenna and other electronic component equipped in the wristwatch may interact with each other such that the gain may be reduced. In the RFID system, in a case where an RFID tag which is a conductor other than an RFID tag to be read is placed at a position nearer to the reader/writer than the RFID tag to be read, the radio waves from the antenna of the reader/writer may be affected by the RFID tag other than the RFID tag to be read, thereby reducing the gain.

In order to lower the reduction of the gain caused by the conductor placed in the vicinity of the antenna, the antenna device is provided with, for example, a pair of antenna elements provided in a direction nearly orthogonal to each other and a 90° phase-difference distributor, and each of the pair of antenna elements includes a loop antenna portion. The 90° phase-difference distributor feeds electrical power to the pair of two antenna elements such that a power feeding phase difference becomes nearly 90°. Since there is an orthogonal relationship between planes of polarization of the pair of two antenna elements, both of a vertically polarized wave and a horizontally polarized wave occur even when the distance between the antenna element and the conductor varies. Therefore, the antenna device radiates the circularly polarized wave regardless of the distance to the conductor.

When the pair of antenna elements is disposed adjacently to each other, electromagnetic coupling occurs between the pair of two antenna elements. In the antenna device, due to a phase deviation caused by the electromagnetic coupling between the pair of antenna elements, even when the power is fed to the pair of antenna elements with the phase difference of nearly 90°, the phase difference between the vertically polarized wave and the horizontally polarized wave does not become nearly 90°. Therefore, the circularly polarized wave may not be radiated. Therefore, for example, in the antenna device, the antenna elements are disposed to be separated from each other in order to reduce an occurrence of the electromagnetic coupling between the pair of antenna elements. Since the antenna elements are disposed to be separated from each other, it may be difficult to miniaturize the antenna device.

For example, in the antenna device, the ends of the two antenna elements located at approaching sides of the two antenna elements that radiate the radio waves having the planes of polarization orthogonal to each other come close enough to cause the electromagnetic coupling between the two antenna elements such that the antenna device may be miniaturized. The power is fed to the two antenna elements with a phase difference compensating a phase deviation caused by the electromagnetic coupling between the two antenna elements and deviated from a phase difference that causes the circularly polarized wave, such that the circularly polarized wave may be radiated by the antenna elements.

Figure 2:
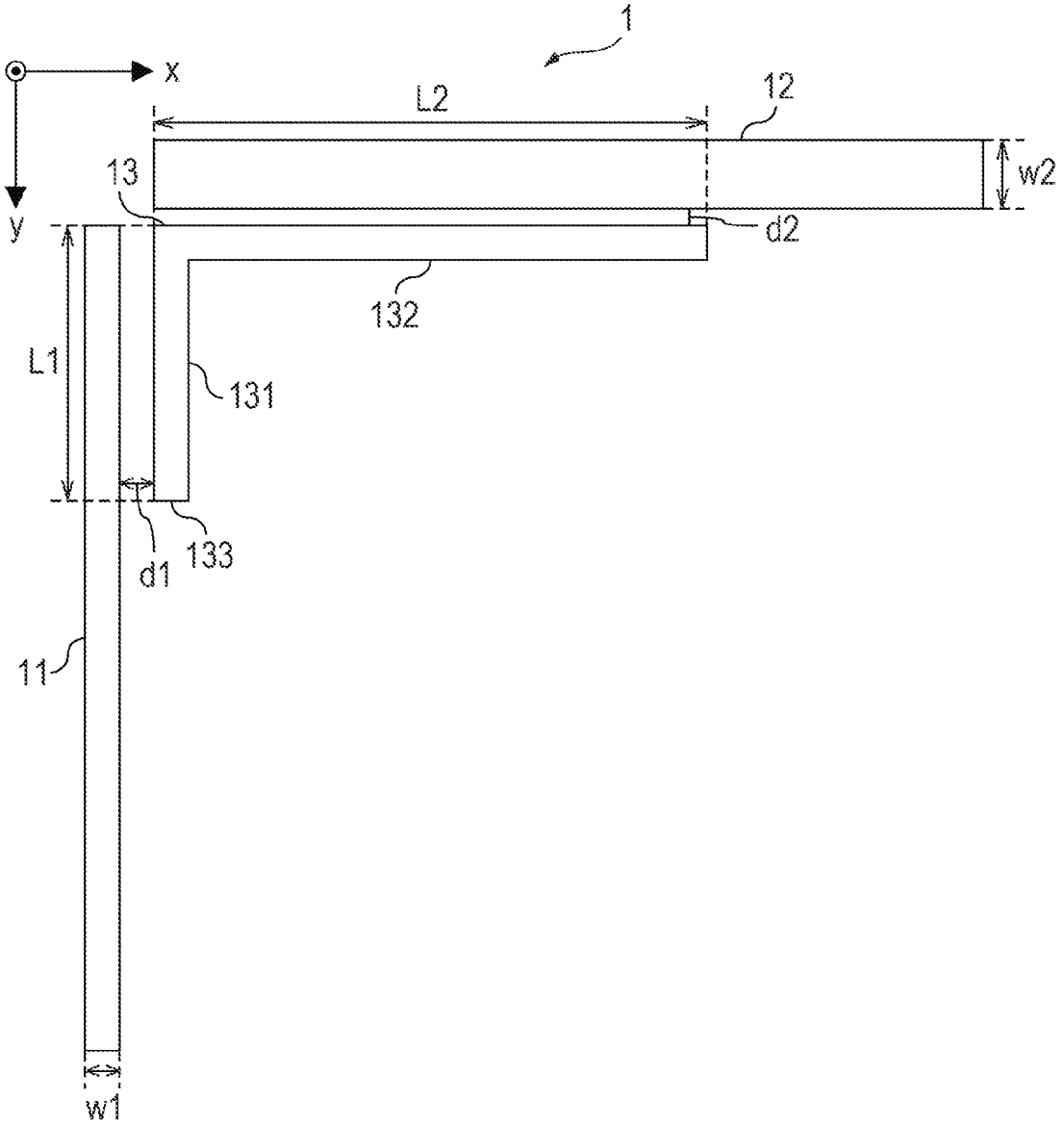
FIG. 2 illustrates an example of a plan view of the antenna device.

FIG. 1 illustrates an example of a perspective view of an antenna device. FIG. 2 illustrates an example of a plan view of the antenna device.

The antenna device 1 includes a ground electrode 10 which is a grounded conductor formed in a flat-plate shape, a first antenna element 11, a second antenna element 12, and a power feeding line 13. The ground electrode 10, the first antenna element 11, the second antenna element 12, and the power feeding line 13 may be made of, for example, a metal such as copper, gold, silver, and nickel or an alloy thereof, or other material having conductivity. The ground electrode 10, the first antenna element 11, the second antenna element 12, and the power feeding line 13 are insulated from each other.

The antenna device 1 may include a substrate to support the ground electrode 10, the first antenna element 11, the second antenna element 12, and the power feeding line 13. The substrate may be made of, for example, a glass epoxy resin called FR-4, or other dielectric material capable of being formed in a layered shape. The ground electrode 10 may be fixed on one surface of the substrate by, for example, etching or adhesion. The first antenna element 11, the second antenna element 12, and the power feeding line 13 may be fixed on the other surface of the substrate by, for example, an adhesion.

Each of the first antenna element 11 and the second antenna element 12 may be a loop antenna formed by a rectangular loop shaped conductor which is wound with one turn. The length of a circumference of the first antenna element 11 and the second antenna element 12 may be slightly shorter than the wavelength of the radio waves radiated from the first antenna element 11 and the second antenna element 12 or received by the first antenna element 11 and the second antenna element 12. In the following, for the convenience of explanation, the wavelength of the radio waves radiated from the first antenna element 11 and the second antenna element 12 or received by the first antenna element 11 and the second antenna element 12 may be referred to as a designed wavelength. The designed wavelength may be denoted by $\lambda$.

The first antenna element 11 and the second antenna element 12 are disposed in such a way that the loop surfaces of the first antenna element 11 and the second antenna element 12 are orthogonal to the surface of the ground electrode 10, and the longitudinal directions of the loop surfaces are parallel to the ground electrode 10, respectively. In the first antenna element 11 and the second antenna element 12, the sides of the loops located adjacent to the ground electrode 10 are disposed to be separated from the surface of the ground electrode 10 by a certain distance, respectively. The first antenna element 11 and the second antenna element 12 are disposed such that the loop surfaces thereof are orthogonal to each other.

In the following, for the convenience of explanation, the longitudinal direction of the second antenna element 12 corresponds to the direction of x axis, the longitudinal direction of the first antenna element 11 corresponds to the direction of y axis, and the normal direction of the surface of the ground electrode 10 corresponds to the direction of z axis.

Two antenna elements are disposed in such a way that the loop surface of the first antenna element 11 and the loop surface of the second antenna element 12 are orthogonal to the ground electrode 10, respectively, and the longitudinal directions of the loop surfaces become parallel to the ground electrode 10. Therefore, the first antenna element 11 radiates radio waves travelling in the direction of z axis and having the plane of polarization parallel to the yz plane. The second antenna element 12 radiates radio waves travelling in the direction of z axis and having the plane of polarization parallel to the xz plane. Further, since the loop surface of the first antenna element 11 and the loop surface of the second antenna element 12 are orthogonal to each other, the plane of polarization of the radio waves radiated from the first antenna element 11 and the plane of polarization of the radio waves radiated from the second antenna element 12 are orthogonal to each other. In the following, for the convenience of explanation, the radio waves radiated from the first antenna element 11 and having the plane of polarization parallel to the yz plane corresponds to the vertically polarized wave, and the radio waves radiated from the second antenna element 12 and having the plane of polarization parallel to the xz plane corresponds to the horizontally polarized wave.

In order to allow a composite wave obtained by combining the vertically polarized wave and the horizontally polarized wave radiated from the antenna device 1 to be the circularly polarized wave, the phase difference between the vertically polarized wave radiated from the first antenna element 11 and the horizontally polarized wave radiated from the second antenna element 12 may be 90°. The amplitude of the vertically polarized wave radiated from the first antenna element 11 may be substantially the same as the amplitude of the horizontally polarized wave radiated from the second antenna element 12.

The ends of the first antenna element 11 and the second antenna element 12 located at mutually approaching sides thereof come close enough to cause the electromagnetic coupling between the first antenna element 11 and the second antenna element 12. For example, the two antenna elements are disposed such that the distance between the ends of the first antenna element 11 and the second antenna element 12 located at mutually approaching sides thereof becomes smaller than $0.2\lambda$. As described above, the ends of the first antenna element 11 and the second antenna element 12 located at mutually approaching sides thereof are made closer to each other enough to cause the electromagnetic coupling between the first antenna element 11 and the second antenna element 12, such that the antenna device 1 is miniaturized. However, a phase deviation occurs between currents fed to the antenna elements due to the electromagnetic coupling between the first antenna element 11 and the second antenna element 12. Therefore, even when the power is directly fed to the first antenna element 11 and the second antenna element 12 with the phase difference of 90°, the phase difference between the vertically polarized wave and the horizontally polarized wave may not become 90°. Therefore, the composite wave of the vertically polarized wave and the horizontally polarized wave may not form a circularly polarized wave.

Figure 3:
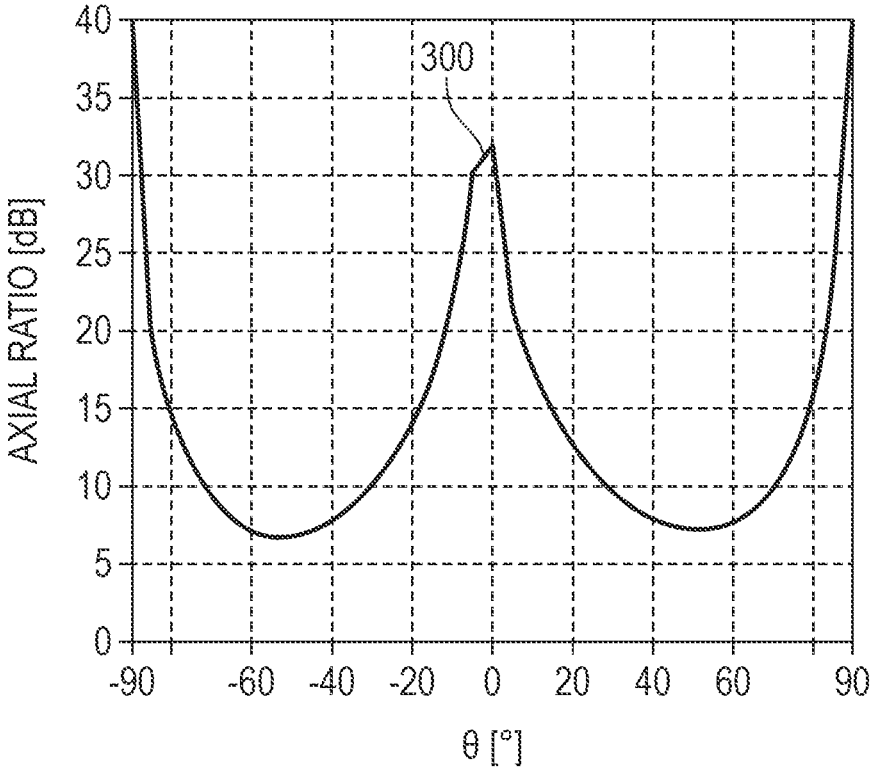
FIG. 3 is a graph illustrating an example of simulation results of an axial ratio.

FIG. 3 is a graph illustrating an example of simulation results of an axial ratio. FIG. 3 illustrates simulation results of the axial ratio for a case where the power is directly fed to the first antenna element 11 and the second antenna element 12 with the phase difference of 90°. In FIG. 3, the horizontal axis indicates an angle θ[°] with respect to the direction of z axis along the xz plane and the vertical axis indicates an axial ratio [dB] which is a ratio of an electric field strength of an elliptically polarized wave in the direction of x axis and an electric field strength of the elliptically polarized wave in the direction of y axis. The graph 300 indicates a relationship between the angle θ with respect to the direction of z axis along the xz plane and the axial ratio for a case where the power is directly fed to the first antenna element 11 and the second antenna element 12 with the phase difference of 90°. When the axial ratio is 0 dB, the electromagnetic wave radiated from the antenna device 1 is a circularly polarized wave. When the axial ratio is 3 dB or less, the electromagnetic wave radiated from the antenna device 1 may be regarded as the circularly polarized wave. As illustrated in the graph 300, the axial ratio does not become 3 dB or less and especially, when θ=0°, the axial ratio becomes 30 dB or more. Accordingly, the composite wave of the vertically polarized wave radiated from the first antenna element 11 and the horizontally polarized wave radiated from the second antenna element 12 does not become a circularly polarized wave.

The power is fed to the first antenna element 11 and the second antenna element 12 through, for example, the power feeding line 13. Therefore, the phase deviation between the fed currents caused by the electromagnetic coupling between the first antenna element 11 and the second antenna element 12 and deviated from the phase difference that causes the circularly polarized wave is compensated.

The power feeding line 13 may be an example of a power feeding part. The power feeding line 13 is an L-shaped conductor. The power feeding line 13 is disposed to be separated from the surface of the ground electrode 10 by the same distance as the distance of a side of the loop of the first antenna element 11 adjacent to the ground electrode 10 from the surface of the ground electrode 10 and a side of the loop of the second antenna element 12 adjacent to the ground electrode 10 from the surface of the ground electrode 10. One linear portion of the L-shaped conductor of the power feeding line 13 is disposed to be parallel to the side of the loop of the first antenna element 11 adjacent to the ground electrode 10. The other linear portion of the L-shaped conductor electrically coupled with one end of the one linear portion is disposed to be parallel to the side of the loop of the second antenna element 12 adjacent to the ground electrode 10. The linear portion of the power feeding line 13 disposed to be parallel to the side of the loop of the first antenna element 11 adjacent to the ground electrode 10 is referred to as a first power feeding part 131 in the following. The linear portion of the power feeding line 13 disposed to be parallel to the side of the loop of the second antenna element 12 adjacent to the ground electrode 10 is referred to as a second power feeding part 132 in the following.

The first power feeding part 131 is disposed to come close enough to be electromagnetically coupled with the side of the loop of the first antenna element 11 adjacent to the ground electrode 10. The second power feeding part 132 is disposed to come close enough to be electromagnetically coupled with the side of the loop of the second antenna element 12 adjacent to the ground electrode 10. The end on the side of the first power feeding part 131 of the power feeding line 13 such as, for example, a distal end of the first power feeding part 131 located away from the second power feeding part 132 is formed as a power feeding point 133 and coupled with a communication processing circuit feeding the power to the antenna element 11. The other end of the power feeding line 13, for example, the end on the side of the second power feeding part 132 is formed as an open end. The power feeding line 13 and the ground electrode 10 form a micro strip line which is an example of a distributed constant line.

When a power is fed from the power feeding point 133 to the power feeding line 13, the current flows in the power feeding line 13 and an electric field is generated around the power feeding line 13. Due to the electric field, the electromagnetic coupling occurs between the first power feeding part 131 and the first antenna element 11 adjacent to each other, and the power is fed from the first power feeding part 131 to the first antenna element 11. Similarly, the electromagnetic coupling occurs between the second power feeding part 132 and the second antenna element 12 adjacent to each other, and the power is also fed from the second power feeding part 132 to the second antenna element 12.

As illustrated in the graph 300, even when the power is directly fed to the first antenna element 11 and the second antenna element 12 with the phase difference of 90°, a composite wave of the vertically polarized wave radiated from the first antenna element 11 and the horizontally polarized wave radiated from the second antenna element 12 does not form the circularly polarized wave. This is because the phase difference between the vertically polarized wave and the horizontally polarized wave is deviated from the phase difference of the power fed to the first antenna element 11 and the second antenna element 12, due to the electromagnetic coupling between the first antenna element 11 and the second antenna element 12. In order to compensate the deviation of the phase difference, the power feeding line 13 is formed in such a way that the length L2 of the second power feeding part 132 is longer than the length L1 of the first power feeding part 131. When the power feeding line 13 is formed as described above, the length of a portion of the first antenna element 11 to which the power is fed becomes different from the length of a portion of the second antenna element 12 to which the power is fed, and the phase deviation of the currents flowing in the respective antenna elements deviated from the phase difference that causes the circularly polarized wave is compensated. Therefore, in the antenna device 1, even when the ends of the first antenna element 11 and the second antenna element 12 located at mutually approaching sides thereof come close enough to cause the electromagnetic coupling between the first antenna element 11 and the second antenna element 12, the composite wave of the vertically polarized wave and the horizontally polarized wave forms the circularly polarized wave.

The current flowing in the power feeding line 13 becomes smaller as the distance from the power feeding point 133 increases. For example, the current flowing in the second power feeding part 132 without having a power feeding point becomes smaller than the current flowing in the first power feeding part 131 having the power feeding point 133. Therefore, when the length of the first power feeding part 131 equals to the length of the second power feeding part 132, the power fed from the second power feeding part 132 to the second antenna element 12 becomes smaller than the power fed from the first power feeding part 131 to the first antenna element 11. When the length of the second power feeding part 132 is made longer than the length of the first power feeding part 131, the difference between the power fed from the first power feeding part 131 to the first antenna element 11 and the power fed from the second power feeding part 132 to the second antenna element 12 becomes smaller.

The direction of the current flowing in the power feeding line 13 is inverted at a position located away from the power feeding point 133 by a distance greater than ¼λ. At the position where the direction of the current is inverted, the amplitude of the current becomes a minimum value and also a relatively strong electrical field is formed around the position. Accordingly, the electromagnetic coupling becomes relatively stronger at the position where the direction of the current is inverted. Accordingly, in order to make the difference between the powers to be fed between the antenna elements smaller, the position where the direction of the current is inverted may be located on the second power feeding part 132 where the amount of the flowing current is relatively small. Therefore, the power feeding line 13 may be formed such that the length of which is longer than ¼λ and the length L1 of the first power feeding part 131 is shorter than ¼λ. Thus, the difference between the powers to be fed between the antenna elements may become smaller.

When the length L2 of the second power feeding part 132 is longer than the length of a side of on the side of the ground electrode 10 of the second antenna element 12, a front end side of the second power feeding part 132 may include a portion which does not feed the power to the second antenna element 12. Therefore, the power feeding line 13 may be formed such that the length L2 of the second power feeding part 132 is shorter than ½λ. The entire length of the power feeding line 13 may be longer than ¼λ and shorter than ¾λ.

The power feeding line 13 may be disposed such that the distance d2 between the second antenna element 12 and the second power feeding part 132 is narrower than the distance d1 between the first antenna element 11 and the first power feeding part 131. Since the electromagnetic coupling between the second power feeding part 132 and the second antenna element 12 becomes strong, the difference in the fed power between the antenna elements becomes smaller in the antenna device 1.

The width w2 of the conductor forming the loop of the second antenna element 12 in a direction orthogonal to the loop surface of the second antenna element 12 may be wider than the width w1 of the conductor forming the loop of the first antenna element 11 in a direction orthogonal to the loop surface of the first antenna element 11. The radio waves radiated from the second antenna element 12 may be stronger compared with those radiated from the first antenna element 11. Therefore, even when the power fed to the second antenna element 12 is smaller than the power fed to the first antenna element 11, the difference in the amplitude of the radiated radio waves between the first antenna element 11 and the second antenna element 12 may become smaller in the antenna device 1.

Figure 4A:
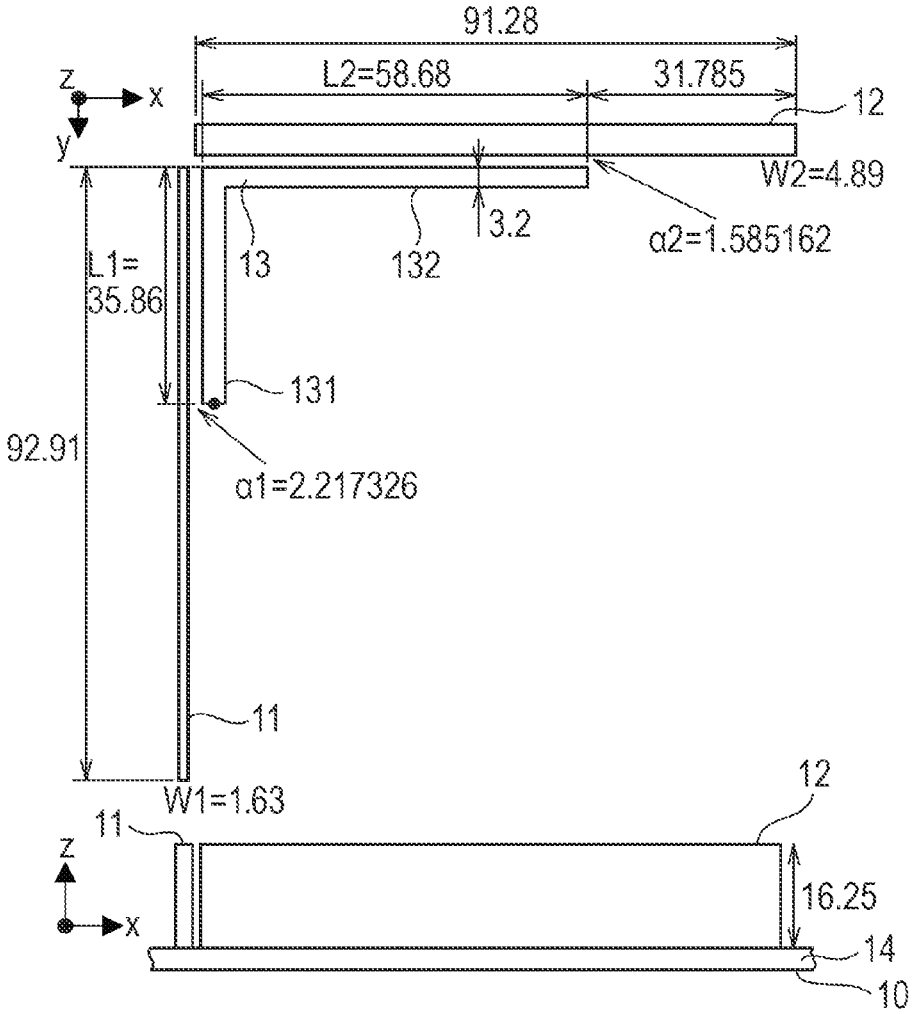
FIG. 4A is a diagram illustrating an example of dimensions of the antenna device.
Figure 4B:
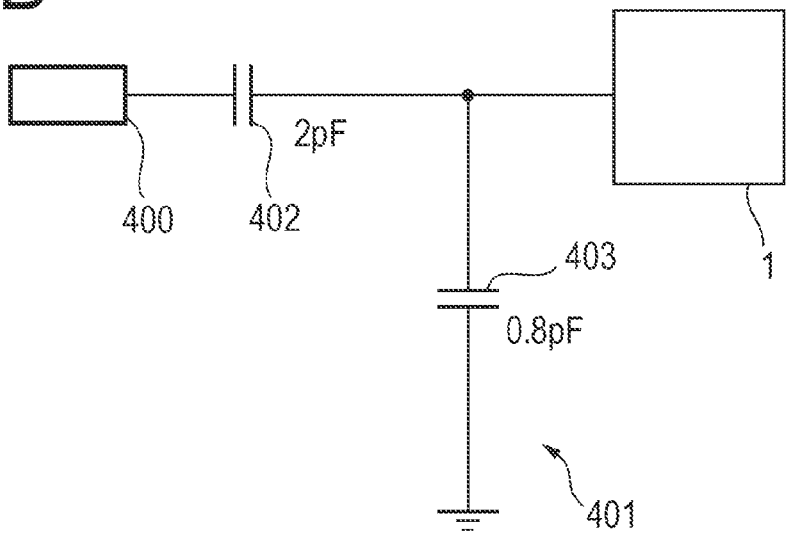
FIG. 4B is a diagram illustrating an example of a matching circuit.

FIG. 4A is a diagram illustrating an example of dimensions of the antenna device. FIG. 4B is a diagram illustrating an example of a matching circuit. The antenna device 1 illustrated in FIG. 4A is used for simulation. The matching circuit illustrated in FIG. 4B is used for an impedance matching of the antenna device 1. In the simulation, the dimensions and physical characteristics of respective components of the antenna device 1 may be set such that the designed wavelength λ becomes a wavelength corresponding to 920 MHz which is used in the RFID system.

For example, the first antenna element 11, the second antenna element 12, and the power feeding line 13 are provided on one surface of a substrate 14 made of a plate-shaped dielectric having a dielectric constant of 4.3 and a thickness of 2.608 mm, and the ground electrode 10 is provided on the other surface of the substrate 14. The conductivity and the thickness of each of the ground electrode 10, the first antenna element 11, the second antenna element 12, and the power feeding line 13 that is a conductor are $5.96\times10^7$ S/m and 50 μm, respectively. The length of the side in the longitudinal direction of the first antenna element 11, for example, the side parallel to the ground electrode 10 is 92.91 mm. The length of the side in the longitudinal direction of the second antenna element 12, for example, the side parallel to the ground electrode 10 is 91.28 mm. Each of the lengths of the sides in the width direction of the first antenna element 11 and the second antenna element 12, for example, the sides orthogonal to the surface of the ground electrode 10 is 16.25. The width w1 in a direction orthogonal to the loop surface of the first antenna element 11 which is a conductor is 1.63 mm. The width w2 in a direction orthogonal to the loop surface of the second antenna element 12 which is a conductor is 4.89 mm. The length of the power feeding line 13 along the first antenna element 11, for example, the length L1 of the first power feeding part 131 is 35.86 mm. The length of the power feeding line 13 along the second antenna element 12, for example, the length L2 of the second power feeding part 132 is 58.68 mm. The width of the power feeding line 13 is 3.2 mm. The distance d1 between the first antenna element 11 and the first power feeding part 131 is 2.217326 mm, and the distance d2 between the second antenna element 12 and the second power feeding part 132 is 1.585162 mm. In the simulation, since the impedance of the antenna device 1 is not matched to 50Ω at 920 MHz, a matching circuit 401 illustrated in FIG. 4B is inserted between a wave source 400 and the antenna device 1. The matching circuit 401 includes a serial capacitor 402 and a parallel capacitor 403. One end of the serial capacitor 402 is connected to the wave source 400 and the other end thereof is connected to the power feeding point of the power feeding line 13 of the antenna device 1 and one end of the parallel capacitor 403. The other end of the parallel capacitor 403 is grounded. The serial capacitor 402 has a capacity of 2 pF and the parallel capacitor 403 has a capacity of 0.8 pF.

Figure 5A:
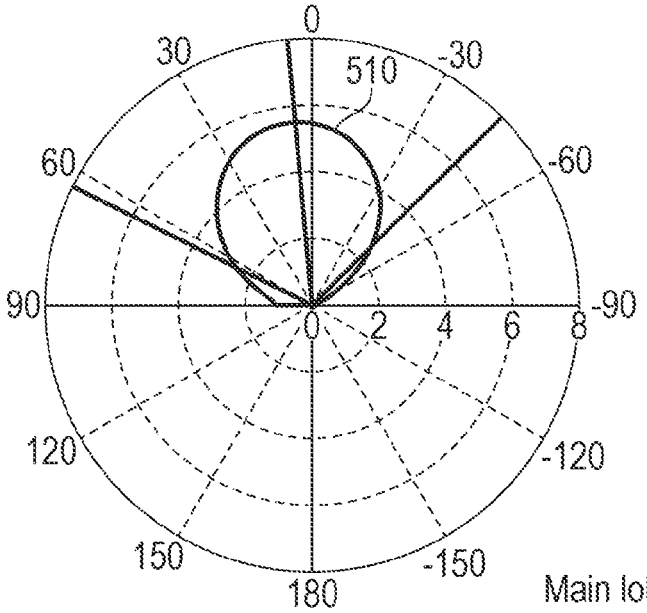
FIG. 5A is a plot illustrating an example of simulation results of an absolute gain.
Figure 5B:
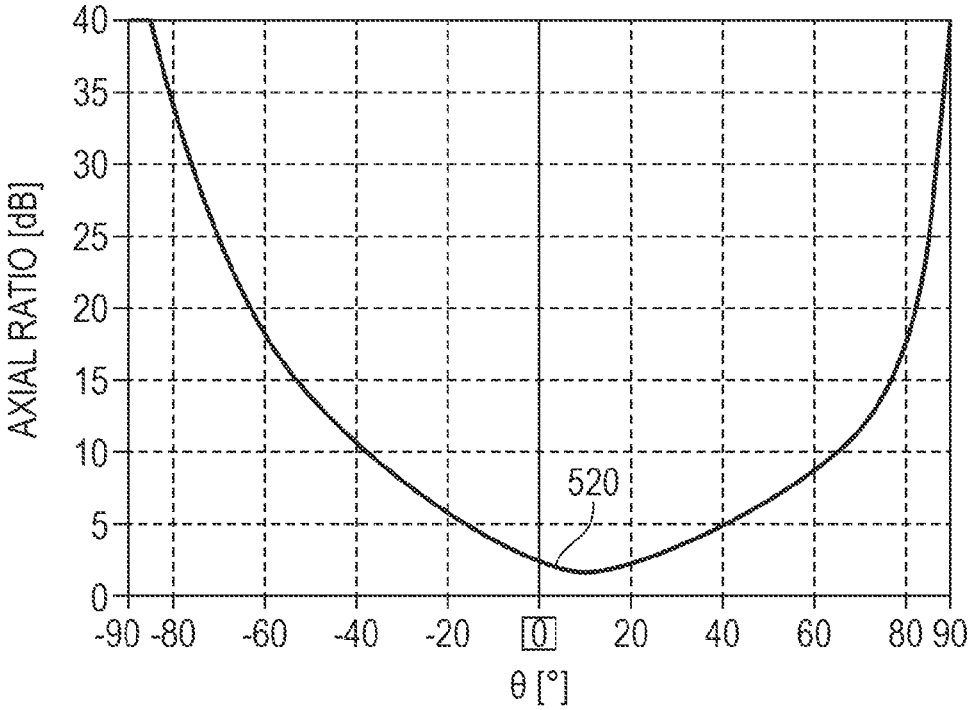
FIG. 5B is a graph illustrating an example of simulation results of the axial ratio.

FIG. 5A illustrates an example of simulation results of an absolute gain. FIG. 5B illustrates an example of simulation results of the axial ratio. In FIG. 5A, simulation results of an operation gain of the antenna device 1 are illustrated. In FIG. 5A, the graph 510 indicates a relationship between an angle θ with respect to the direction of z axis along the xz plane and the operation gain [dBi] of the antenna device 1. As illustrated in the graph 510, the operation gain of the antenna device 1 becomes the maximum value of 5.52 dB for a case of θ=5° and the half-value angle is 108.8°. As described above, an excellent gain may be obtained.

In FIG. 5B, the horizontal axis indicates an angle θ[°] with respect to the direction of z axis along the xz plane and the vertical axis indicates an axial ratio [dB]. The graph 520 indicates a relationship between the angle θ with respect to the direction of z axis along the xz plane and the axial ratio. As illustrated in the graph 520, when the angle is zero (i.e., θ=0°) or the angle is in the vicinity of zero, the axial ratio becomes 3 dB or less and the composite wave of the vertically polarized wave radiated from the first antenna element 11 and the horizontally polarized wave radiated from the second antenna element 12 forms the circularly polarized wave. In this case, the phase difference between the current fed to the first antenna element 11 and the current fed to the second antenna element 12 may be approximately 110°.

In the antenna device, the ends of the two antenna elements located at mutually approaching sides of the two antenna elements that radiate the radio waves having the planes of polarization orthogonal to each other come close enough to cause the electromagnetic coupling between the antenna elements. Therefore, the antenna device is miniaturized. The antenna device includes the power feeding line for feeding the power with a phase difference compensating the phase deviation between the currents fed to the antenna elements caused by the electromagnetic coupling between two antenna elements and deviated from the phase difference corresponding to the circularly polarized wave. Therefore, the antenna device radiates a circularly polarized wave. The antenna device may not require, for example, the 90° phase-difference distributor. Therefore, a space in which other electronic component may be provided is ensured in the vicinity of the antenna device and an apparatus including the antenna device may be miniaturized as well.

When the antenna device is equipped in a device such as, for example, in the wristwatch equipped with the GPS function, the shapes of the respective antenna elements are adjusted to be matched with the shape of the device. For example, the first antenna element, the second antenna element, and the power feeding line may be formed to be curved along a plane parallel to the surface of the ground electrode.

Figure 6:
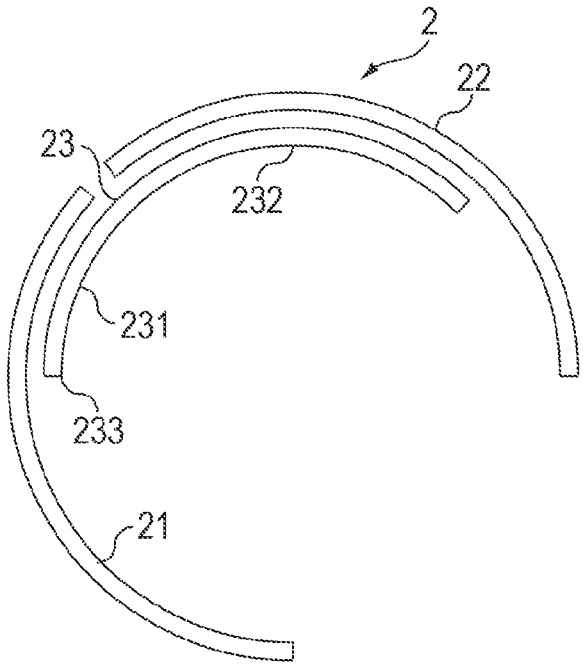
FIG. 6 illustrates an example of a plan view of an antenna device.

FIG. 6 illustrates an example of a plan view of an antenna device. The shapes of the antenna elements and the shape of the power feeding line of an antenna device 2 are different from those of the antenna device 1 illustrated in FIG. 1 or FIG. 2. In the following, the shapes of the antenna elements and the shape of the power feeding line, and related descriptions thereof will be described.

The first antenna element 21 and the second antenna element 22 included in the antenna device 2 may be a loop antenna in which a loop surface is formed along the direction orthogonal to the surface of the ground electrode and the longitudinal direction thereof is parallel to the ground electrode. For example, the sides in the longitudinal direction of the first antenna element 21 and the second antenna element 22 are curved in a circular arc shape to be matched with an outer appearance of, for example, a wristwatch in the plane parallel to the surface of the ground electrode. The first antenna element 21 and the second antenna element 22 are disposed such that the plane of polarization of the radio waves radiated from the first antenna element 21 and the plane of polarization of the radio waves radiated from the second antenna element 22 are orthogonal to each other.

The power feeding line 23 may be a circular arc-shaped conductor. The power feeding line 23 is disposed to be separated from the surface of the ground electrode by the same distance as the distance from the sides of the first antenna element 21 and the second antenna element 22 located adjacent to the ground electrode. The power feeding line 23 includes a first power feeding part 231 disposed along the side of the first antenna element 21 adjacent to the ground electrode and a second power feeding part 232 disposed along the side of the second antenna element 22 adjacent to the ground electrode. The first power feeding part 231 and the side of the first antenna element 21 adjacent to the ground electrode are electromagnetically coupled with each other and the second power feeding part 232 and the side of the second antenna element 22 adjacent to the ground electrode are electromagnetically coupled with each other, such that the power is fed to the antenna elements. The end on the side of the first power feeding part 231 of the power feeding line 23 is a power feeding point 233 and the end on the side of the second power feeding part 232 of the power feeding line 23 is an open end. In the power feeding line 23, the length of the second power feeding part 232 without having a power feeding point is longer than the length of the first power feeding part 231 having the power feeding point 233.

Since two antenna elements are disposed to be located adjacent to each other enough to cause the electromagnetic coupling, and the phase deviation caused by the electromagnetic coupling between two antenna elements and deviated from the circularly polarized wave is compensated by the power feeding line, the antenna device may radiate the circularly polarized wave and be miniaturized.

Figure 7:
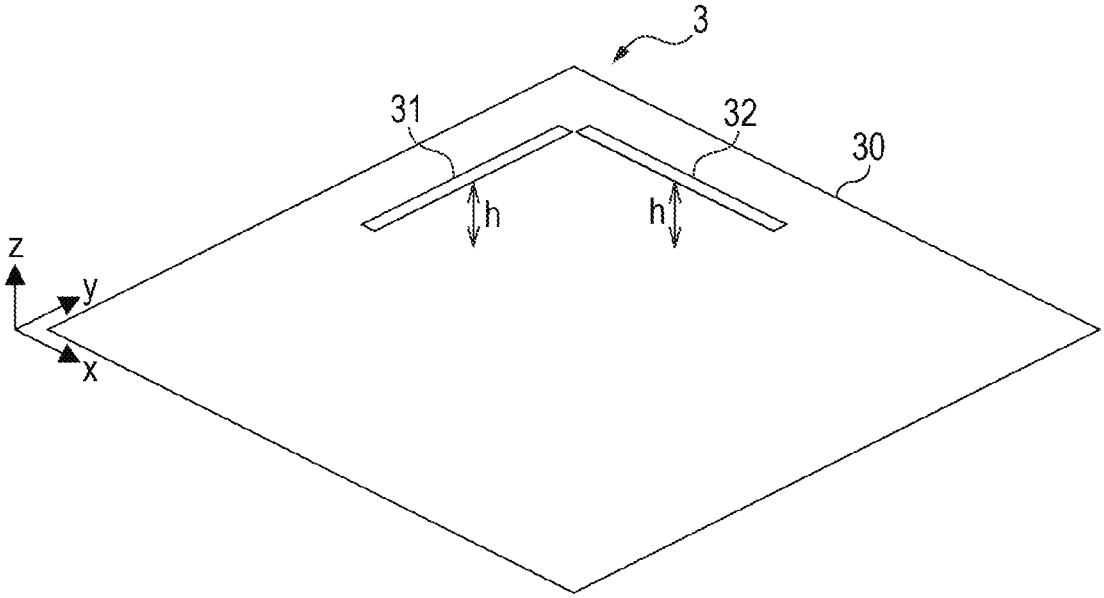
FIG. 7 illustrates an example of a perspective view of the antenna device.
Figure 8:
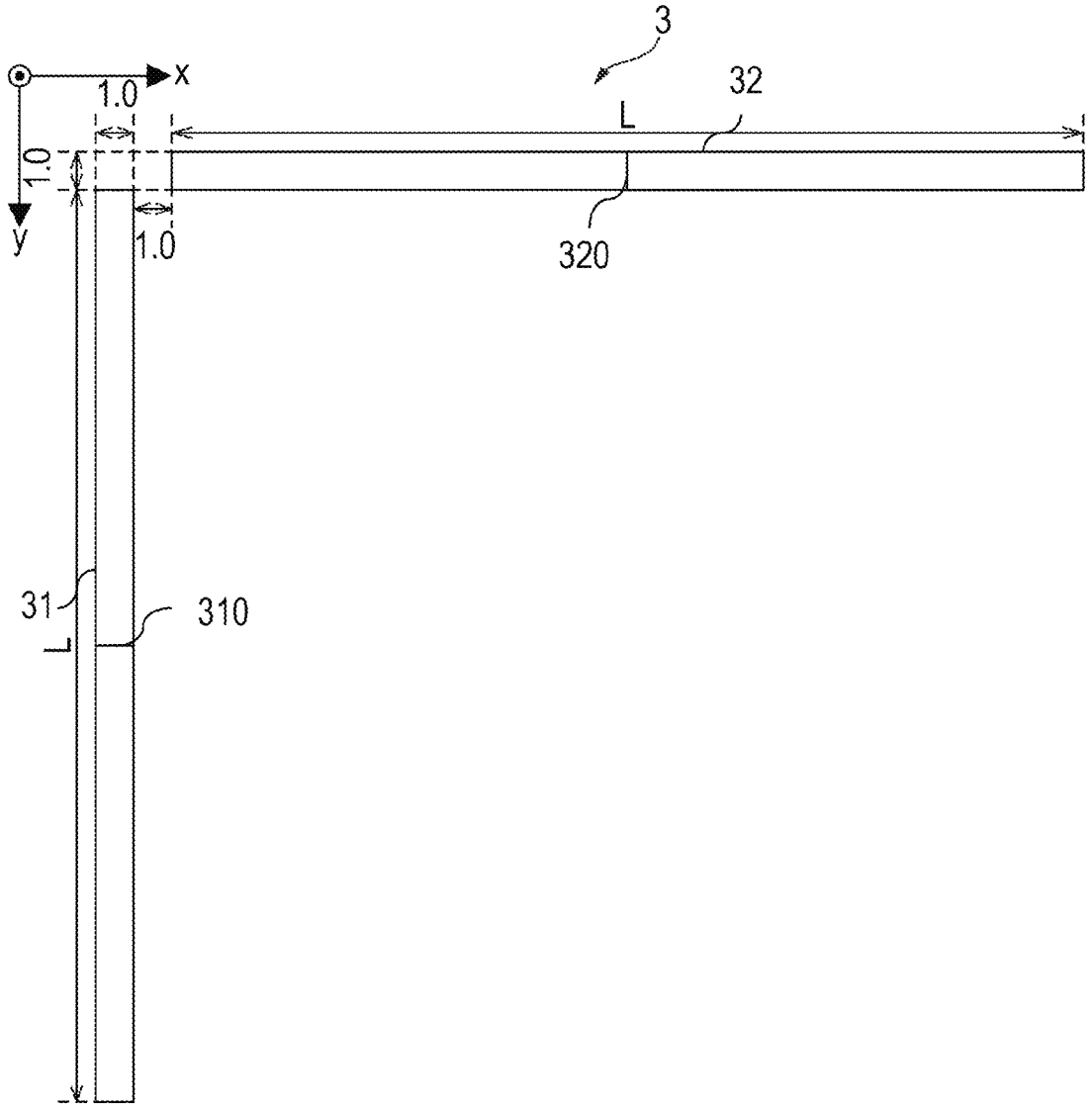
FIG. 8 illustrates an example of a plan view of an antenna device.

FIG. 7 illustrates an example of a perspective view of an antenna device. FIG. 8 illustrates an example of a plan view of an antenna device. The antenna device illustrated in FIG. 7 and FIG. 8 is different from the antenna device illustrated in FIG. 1 or FIG. 2 in that the first antenna element and the second antenna element are dipole antennas.

An antenna device 3 includes a ground electrode 30 which is a grounded conductor formed in a flat-plate shape, a first antenna element 31, and a second antenna element 32. The ground electrode 30, the first antenna element 31, and the second antenna element 32 may be made of, for example, a metal such as copper, gold, silver, and nickel or an alloy thereof, or other material having conductivity. The ground electrode 30, the first antenna element 31, and the second antenna element 32 are insulated from each other.

The first antenna element 31 and the second antenna element 32 may be the dipole antenna formed of a linear conductor having substantially the same length L. The length L of the first antenna element 31 and the second antenna element 32 in the longitudinal direction thereof may be shorter than ½λ.

The first antenna element 31 and the second antenna element 32 are disposed such that the longitudinal direction thereof is parallel to the surface of the ground electrode 30, and the antenna elements 31 and 32 are located away from the surface of the ground electrode 30 by a certain distance h. The first antenna element 31 and the second antenna element 32 are disposed to be orthogonal to each other in the longitudinal direction thereof. For the convenience of explanation, in the following, the longitudinal direction of the second antenna element 32 corresponds to the direction of x axis, the longitudinal direction of the first antenna element 31 corresponds to the direction of y axis, and the normal direction of the surface of the ground electrode 30 corresponds to the direction of z axis.

Since the first antenna element 31 and the second antenna element 32 are arranged to be orthogonal to each other in the longitudinal direction thereof, the plane of polarization of the radio waves radiated from the first antenna element 31 and the plane of polarization of the radio waves radiated from the second antenna element 32 are orthogonal to each other. Therefore, the first antenna element 31 radiates radio waves travelling in the direction of z axis and having the plane of polarization parallel to the yz plane. The second antenna element 32 radiates radio waves travelling in the direction of z axis and having the plane of polarization parallel to the xz plane. For the convenience of explanation, in the following, the radio waves radiated from the first antenna element 31 and having the plane of polarization parallel to the yz plane corresponds to the vertically polarized wave, and the radio waves radiated from the second antenna element 32 and having the plane of polarization parallel to the xz plane corresponds to the horizontally polarized wave.

The first antenna element 31 includes at the center thereof a first power feeding point 310 to which the power is fed from a communication processing circuit. Similarly, the second antenna element 32 includes at the center thereof a second power feeding point 320 to which the power is fed from a communication processing circuit.

The radio waves radiated from the antenna device 3 include the radio waves generated by image currents induced at a position 2*h* located away from each antenna element by sandwiching the ground electrode 30, in addition to the vertically polarized wave radiated from the first antenna element 31 and the horizontally polarized wave radiated from the second antenna element 32. The ends of the first antenna element 31 and the second antenna element 32 located at mutually approaching sides thereof come close enough to cause the electromagnetic coupling between the first antenna element 31 and the second antenna element 32.

Therefore, when the difference between the phase of the current fed to the first antenna element 31 and the phase of the current fed to the second antenna element 32 is 90°, the radio waves radiated from the antenna device 3 does not form the circularly polarized wave. Therefore, the phase difference of the currents to be fed to the antenna elements are adjusted such that the phase difference between the horizontally polarized wave and the vertically polarized wave becomes 90° and the circularly polarized wave is formed. For example, the electromagnetic coupling between the antenna elements becomes weaker as the length of each of the antenna elements becomes shorter. Therefore, when the length of each of the antenna elements is a certain length or less, the phase difference of the current to be fed to the antenna elements may be 90°.

Figure 9:
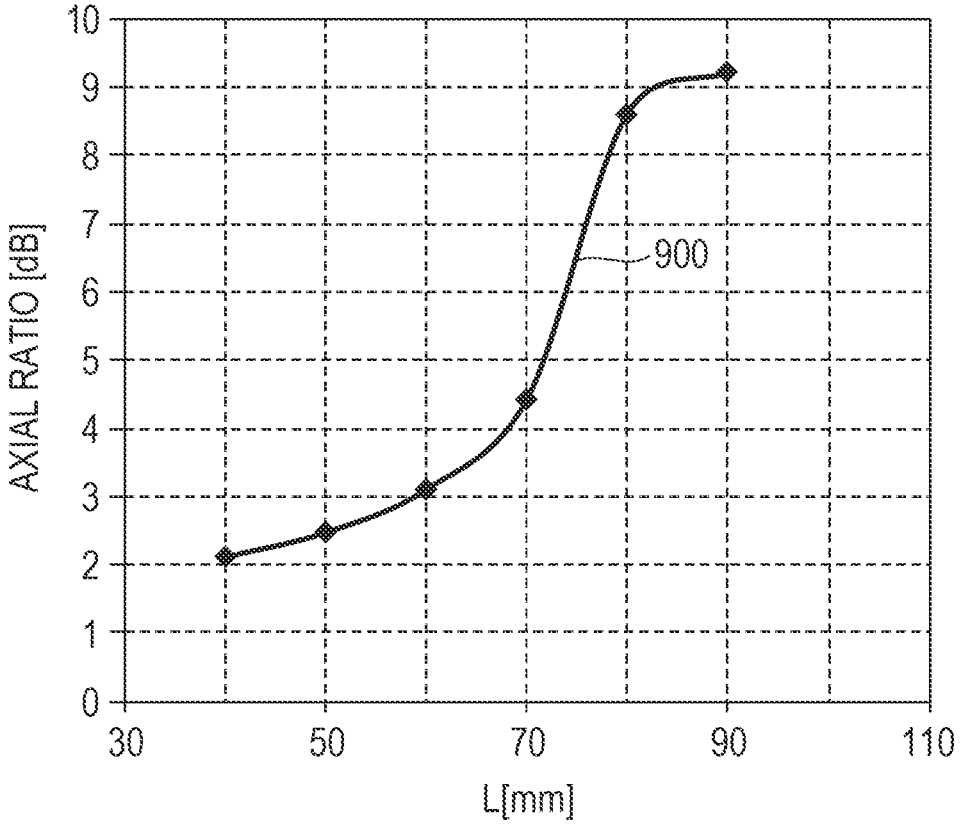
FIG. 9 is a graph illustrating an example of simulation results.

FIG. 9 is a graph illustrating an example of simulation results. FIG. 9 illustrates simulation results which indicate a relationship between the length and axial ratio of the antenna elements when the power is fed with the phase difference of 90° when the frequency of 1.5 GHz is used by the antenna device 3. In the simulation, the distance h between the ground electrode 30 and each of the first antenna element 31 and the second antenna element 32 is 20 mm. Each of the width of the first antenna element 31 and the width of the second antenna element 32 is 1 mm. The distance between the ends of the first antenna element 31 and the second antenna element 32 located at mutually approaching sides thereof is 0.1 mm.

In FIG. 9, the horizontal axis indicates a length L [mm] of the first antenna element 31 and the second antenna element 32, and the vertical axis indicates an axial ratio [dB]. The graph 900 indicates a relationship between the length L of the first antenna element 31 and the second antenna element 32 in the longitudinal direction thereof and the axial ratio of the antenna element, for a case where the power is fed to the antenna elements with the phase difference of 90°. As illustrated in the graph 900, when the length L of the first antenna element 31 and the second antenna element 32 in the longitudinal direction thereof is 60 mm or more, the axial ratio becomes greater than 3 dB. Therefore, when the length L of the first antenna element 31 and the second antenna element 32 in the longitudinal direction thereof is 60 mm or more, the phases of the currents fed to two antenna elements are adjusted to compensate the deviation from the phase difference that causes the circularly polarized wave. In the simulation, the frequency is set to 1.5 GHz and the designed wavelength is 20 cm. Therefore, when the length L of the first antenna element 31 and the second antenna element 32 in the longitudinal direction thereof is equal to or greater than 3/10 of the designed wavelength, the phases of the currents fed to two antenna elements may be adjusted to compensate the deviation from the phase difference that causes the circularly polarized wave.

Figure 10:
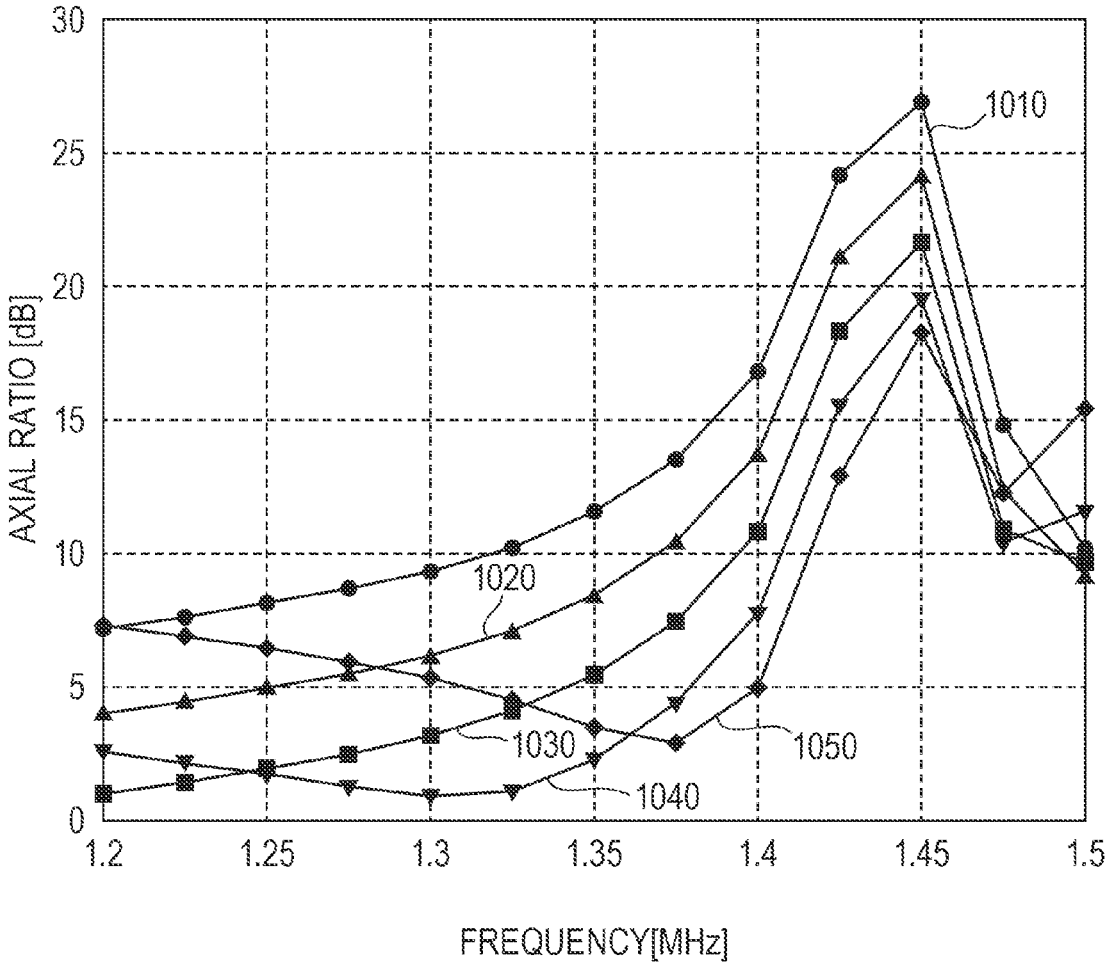
FIG. 10 is a graph illustrating another example of simulation results.

FIG. 10 is a graph illustrating an example of simulation results. In FIG. 10, the simulation results of the axial ratio are illustrated for a case where the power is fed with various phase differences. In the simulation, the length L of the first antenna element 31 and the second antenna element 32 is 90 mm corresponding to a resonance frequency of 1.5 GHz. The distance h between the ground electrode 30 and each of the first antenna element 31 and the second antenna element 32 is 20 mm. Each of the width of the first antenna element 31 and the width of the second antenna element 32 is 1 mm. The distance between the ends of the first antenna element 31 and the second antenna element 32 located at mutually approaching sides thereof is 0.1 mm.

In FIG. 10, the horizontal axis indicates a frequency [MHz] and the vertical axis indicates an axial ratio [dB]. The graph 1010 indicates a relationship between the frequency and the axial ratio when the power is fed to the first antenna element 31 and the second antenna element 32 with a phase difference of 70°. The graph 1020 indicates the relationship between the frequency and the axial ratio when the power is fed to the first antenna element 31 and the second antenna element 32 with a phase difference of 90°. The graph 1030 indicates the relationship between the frequency and the axial ratio when the power is fed to the first antenna element 31 and the second antenna element 32 with a phase difference of 110°. The graph 1040 indicates the relationship between the frequency and the axial ratio when the power is fed to the first antenna element 31 and the second antenna element 32 with a phase difference of 130°. The graph 1050 indicates the relationship between the frequency and the axial ratio when the power is fed to the first antenna element 31 and the second antenna element 32 with a phase difference of 150°.

As illustrated in the graph 1030, when the power is fed to the first antenna element 31 and the second antenna element 32 with the phase difference of 110°, the axial ratio becomes 3 dB or less in the vicinity of the frequency of 1.2 MHz. Therefore, when the power is fed to the first antenna element 31 and the second antenna element 32 with the phase difference of 110°, the antenna device 3 radiates the radio waves having the frequency of 1.2 MHz as the circularly polarized wave.

As illustrated in the graph 1040, when the power is fed to the first antenna element 31 and the second antenna element 32 with the phase difference of 130°, the axial ratio becomes equal to or less than 3 dB in the vicinity of the frequency of 1.3 MHz. Therefore, when the power is fed to the first antenna element 31 and the second antenna element 32 with the phase difference of 130°, the antenna device 3 radiates the radio waves having the frequency of 1.3 MHz as the circularly polarized wave.

The first antenna element and the second antenna element may be formed by the dipole antenna. In this case, the ends of the antenna elements located at mutually approaching sides thereof come close enough to cause the electromagnetic coupling and the power is fed to the antenna elements such that the deviation caused by the electromagnetic coupling and deviated from the phase difference that causes the circularly polarized wave is compensated. Therefore, the circularly polarized wave is radiated while the antenna device is miniaturized.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to an illustrating of the superiority and inferiority of the invention. Although the embodiments of the present invention have been described in detail, it should be understood that the various changes, substitutions, and alterations could be made hereto without departing from the spirit and scope of the invention.

What is claimed is:

1. An antenna device comprising:

a first antenna element configured to radiate first radio waves having a first plane of polarization; and a second antenna element configured to radiate second radio waves having a second plane of polarization orthogonal to the first plane of polarization, wherein ends of the first antenna element and the second antenna element located at mutually approaching sides are disposed in a positional relationship that causes an electromagnetic coupling between the first antenna element and the second antenna element, and a phase deviation caused by the electromagnetic coupling based on the positional relationship is compensated by an electrical power fed to the first antenna element and the second antenna element with a phase difference that causes a composite wave of the first radio waves and the second radio waves to form a circularly polarized wave.

2. The antenna device according to claim 1, further comprising:

a wound electrode which is a conductor formed in a flat-plate shape; and a power feeding element configured to feed the power to the first antenna element and the second antenna element, wherein the power feeding element includes a first power feeding part disposed to be electromagnetically coupled with the first antenna element along a first side of the first antenna element adjacent to the ground electrode and configured to include a power feeding portion, and a second power feeding part electrically connected to an end of the first power feeding part and disposed to be electromagnetically coupled with the second antenna element along a second side of the second antenna element adjacent to the ground electrode.

3. The antenna device according to claim 2, wherein a length of the second power feeding part is longer than a length of the first power feeding part.

4. The antenna device according to claim 2, wherein each of the first antenna element and the second antenna element is configured to receive radio waves having a designed wavelength, the length of the power feeding element is longer than one fourth of the predetermined designed wavelength, and the length of the first power feeding part is shorter than one fourth of the predetermined designed wavelength.

5. The antenna device according to claim 1, further comprising:

a wound electrode which is a conductor formed in a flat-plate shape, wherein each of the first antenna element and the second antenna element is a loop antenna formed by a loop shaped conductor, and the first antenna element and the second antenna element are disposed such that a loop surface of the first antenna element and a loop surface of the second antenna element are orthogonal to a surface of the ground electrode and a first side of the first antenna element adjacent to the ground electrode and a second side of the second antenna element adjacent to the ground electrode are parallel to the ground electrode by being separated from the ground electrode by a distance, respectively.

6. The antenna device according to claim 2, wherein the first antenna element is disposed such that the first side is parallel to the ground electrode by being separated from the first power feeding part by a first distance, and the second antenna element is disposed such that the second side is parallel to the ground electrode by being separated from the second power feeding part by a second distance.

7. The antenna device according to claim 6, wherein the second distance is narrower than the first distance.

8. The antenna device according to claim 1, wherein each of the first antenna element and the second antenna element is a loop antenna formed by a loop shaped conductor, a loop surface of the first antenna element and a loop surface of the second antenna element are orthogonal to the surface of a ground electrode formed in a flat-plate shape, and a width of a conductor forming a loop of the second antenna element in a direction orthogonal to the loop surface of the second antenna element is wider than a width of a conductor forming a loop of the first antenna element in a direction orthogonal to the loop surface of the first antenna element.

9. The antenna device according to claim 1, further comprising:

a ground electrode which is a conductor formed in a flat-plate shape, wherein each of the first antenna element and the second antenna element is a dipole antenna formed by a linear conductor, and the first antenna element and the second antenna element are disposed to be located away from the surface of the ground electrode by a predetermined distance and parallel to the surface of the ground electrode while a longitudinal direction of the first antenna element and a longitudinal direction of the second antenna element are orthogonal to each other.

10. An antenna device, comprising:

a conductor formed in a flat-plate shape;

a first antenna element provided above the conductor and configured to radiate first radio waves having a first plane of polarization;

a second antenna element provided above the conductor and including a second end disposed in a positional relationship with a first end of the first antenna element that causes an electromagnetic coupling between the first antenna element and the second antenna element, and configured to radiate second radio waves having a second plane of polarization orthogonal to the first plane of polarization;

a first power feeding part disposed to be parallel to the first antenna element with a first distance; and a second power feeding part disposed to be parallel to the second antenna element with a second distance, wherein one end of the first power feeding part and one end of the second power feeding part are coupled in the vicinity of the first end of the first antenna element and the second end of the second antenna element, and a first length of the first power feeding part is shorter than a second length of the second power feeding part.

11. The antenna device according to claim 10, wherein the first distance is longer than the second distance.

12. The antenna device according to claim 10, wherein the second length is shorter than one half of a designed wavelength for the first and second antenna elements.

13. The antenna device according to claim 10, wherein the other end of the first power feeding part is a power feeding point and the other end of the second power feeding part is an open end.

14. The antenna device according to claim 10, wherein each of the first antenna element and the second antenna element is a loop antenna formed by a loop shaped conductor, and a width in a direction orthogonal to a loop surface of the second antenna element is wider than a width in a direction orthogonal to a loop surface of the first antenna element.

* * * * *